United States Patent [19]

Behrens et al.

[11] Patent Number: 4,780,010

[45] Date of Patent: Oct. 25, 1988

[54] RIBBON SPOOLS FOR A RELOADABLE CASSETTE FOR A TYPEWRITER OR SIMILAR OFFICE MACHINE

[75] Inventors: Rolf Behrens, Oldenburg; Hermann Jendricke, Varel; Manfred Sauer, Wilhelmshaven; Klaus-Dieter Frerichs, Schortens; Alfred Keiter, Wilhelmshaven; Andreas Wesselhöft, Wilhelmshaven; Hans-Peter Heins, Wilhelmshaven; Heinz Lange, Wilhelmshaven, all of Fed. Rep. of Germany

[73] Assignee: Olympia Aktiengesellschaft, Wilhelmshaven, Fed. Rep. of Germany

[21] Appl. No.: 884,527

[22] Filed: Jul. 11, 1986

[30] Foreign Application Priority Data

Jul. 11, 1985 [DE] Fed. Rep. of Germany ..... 3524730

[51] Int. Cl.[4] ..... B41J 32/00

[52] U.S. Cl. ..... 400/208; 400/228; 400/238; 400/250

[58] Field of Search ..... 400/238, 250, 207, 208, 400/208.1, 235, 236, 242, 243, 244, 245, 246, 248

[56] References Cited

U.S. PATENT DOCUMENTS

| | | | |
|---|---|---|---|
| 2,366,147 | 12/1944 | May | 400/242 X |
| 2,486,473 | 11/1949 | Hart | 400/244 X |
| 3,151,723 | 10/1964 | Wendt | 400/207 |
| 3,286,808 | 11/1966 | Arena et al. | 400/208.1 |
| 3,482,684 | 12/1969 | Schladale | 400/208 X |
| 4,265,553 | 5/1981 | Hatsell | 400/238 |
| 4,368,992 | 1/1983 | Gagnebin | 400/208 X |
| 4,614,448 | 9/1986 | Suzaki et al. | 400/208 |
| 4,623,274 | 11/1986 | Ohsaki | 400/208 |

FOREIGN PATENT DOCUMENTS

| | | | |
|---|---|---|---|
| 196283 | 11/1984 | Japan | 400/207 |
| 1455915 | 11/1976 | United Kingdom | 400/208 |

*Primary Examiner*—Charles A. Pearson

*Attorney, Agent, or Firm*—Spencer & Frank

[57] ABSTRACT

A ribbon cassette for an office machine, composed of: a cassette housing removably mountable in the machine, the housing having an entrance opening, an exit opening, an openable cover and elements constituting deflection points; a supply spool and a take-up spool having a core, each of the spools being removably mounted in the cassette housing; a carbon ribbon initially wound in the form of a coil on the supply spool, the ribbon having a leading end at the outer surface of the coil to be received by the take-up spool core to permit the ribbon to be wound up on the take-up spool while being unwound from the supply spool; and a fastening member secured to the leading end of the ribbon for threading the ribbon around the deflection points; and wherein the core is formed for enabling the fastening member to be fixed thereto to aid winding of the ribbon on the take-up spool.

21 Claims, 2 Drawing Sheets

Figure 1:
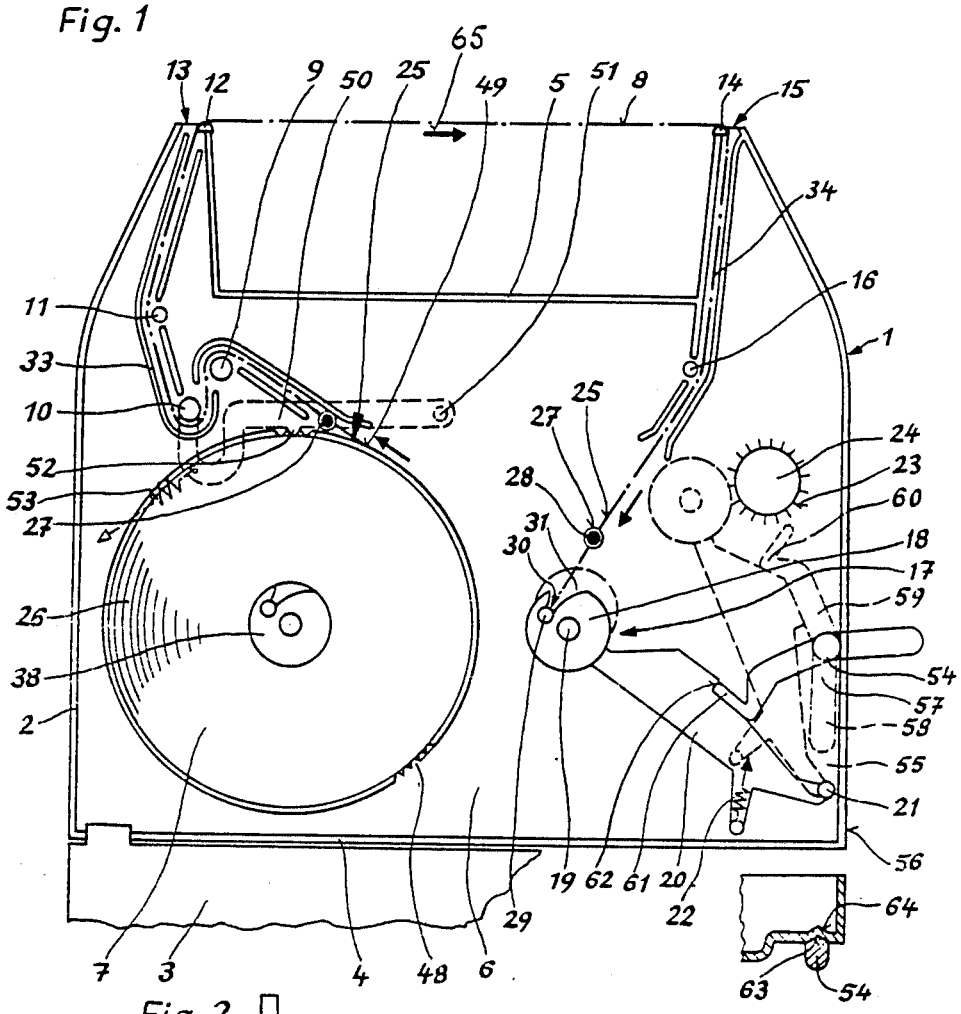

RIBBON SPOOLS FOR A RELOADABLE CASSETTE FOR A TYPEWRITER OR SIMILAR OFFICE MACHINE

The invention relates to ribbon spools for a reloadable cassette for a typewriter or office machine of the type defined in the preamble of claim 1.

U.S. Pat. No. 3,731,781 discloses a removable cassette for a carbon ribbon to be used in a printer having a rotatable drive element for ribbon advance, with the cassette being composed of a housing accommodating a ribbon supply spool and a take-up spool. A pivotal supply roller equipped with a sprocket wheel here cooperates with a take-up spool disposed on a stationary axis to wind up the carbon ribbon. For exchanging the cassette, the supply roller must first be put out of engagement with the take-up spool. This exchange process requires a plurality of manipulations since, after insertion of the new cassette in the receiving device of the machine, the supply roller must be brought back into engagement with the take-up spool.

German Pat. No. 2,553,329 discloses a ribbon cassette for a typewriter or office machine of a similar construction in which the supply roller and its sprocket wheel are also disposed in the cassette. The supply roller here remains in constant engagement with the carbon ribbon on the take-up spool. In this way it is possible to perform the exchange of ribbon cassettes with only one hand. This prior art ribbon cassette is very expensive since the members for driving the carbon ribbon contained in the ribbon cassette are discarded together with the ribbon when it is used up. Since, moreover, the supply roller is always in engagement with the take-up spool and the drive elements are mounted, on the one hand, in the bottom portion and, on the other hand, in the cover which is fixed to the bottom portion, it is not possible to exchange the supply and take-up spools.

It is the object of the invention to provide ribbon spools for a reloadable cassette which has a cover that closes an opening, with such spools being easily exchanged when the ribbon is used up and which, as disposable products, involve only a small loss of material and low shipping and storage costs.

This is accomplished by the invention as characterized in claim 1.

Figure 2:
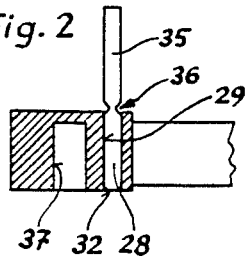
Figure 3:
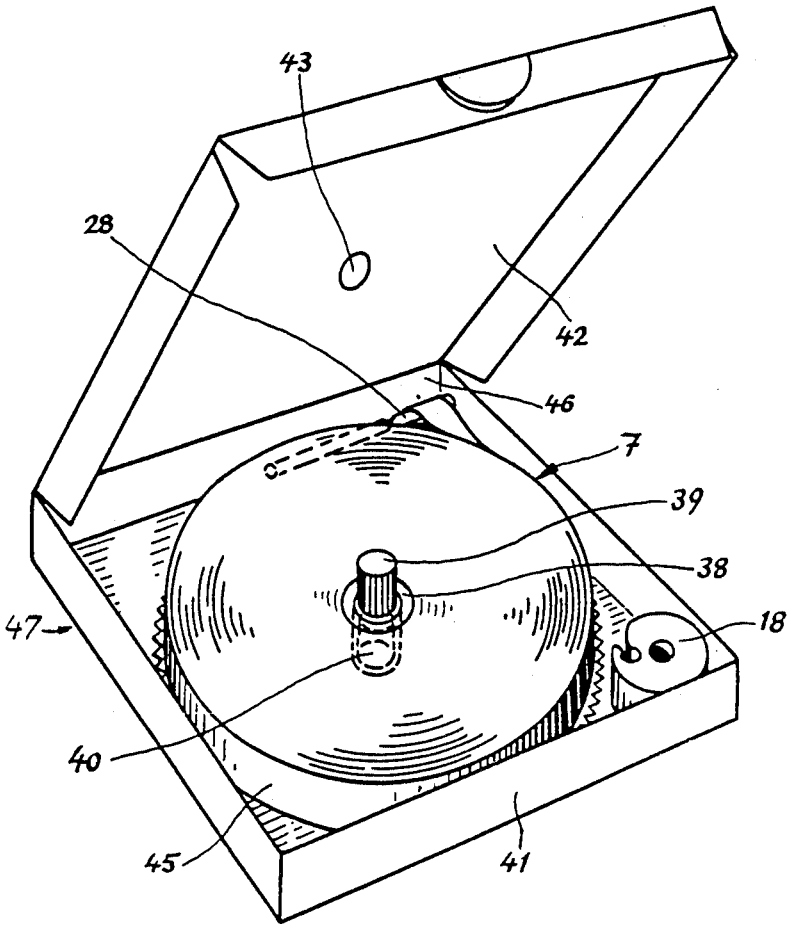

The ribbon spools according to the invention are easily exchanged in the reloadable ribbon cassettes when the ribbon is used up, with the disposable parts causing only a slight consumption of material and therefore are extremely inexpensive. Since, moreover, the ribbon spools also require only small packages, storage and shipping costs are also reduced. The ribbon spools can be inserted into the reloadable cassettes and can be removed therefrom when the cassette is disposed in the receiving device in the machine or in the removed position. The reloadable cassette can be inserted into the receiving device of the machine or removed therefrom by one-handed manipulation. Further advantageous features of the invention are disclosed in the further dependent claims. Details of the invention will be described more thoroughly below in connection with embodiments that are illustrated in the drawings. It is shown in:

FIG. 1, a reloadable cassette with its cover opened;

FIG. 2, a detail of FIG. 1;

FIG. 3, a graphical representation of the package; and

Figure 4:
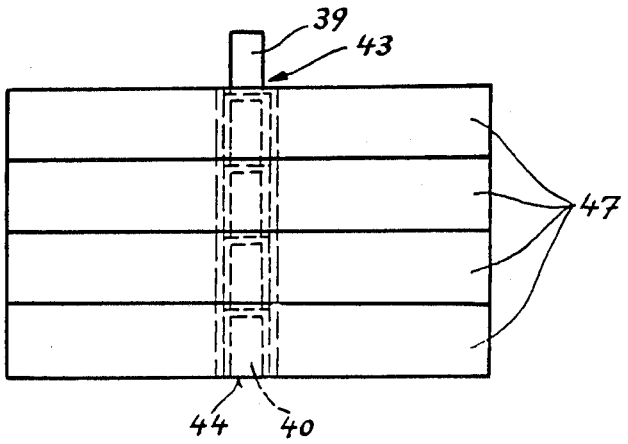

FIG. 4, a plurality of superposed, stacked packages.

FIG. 1 shows a reloadable ribbon cassette 1 composed of a cup-shaped bottom member 2 and a cover 3 which closes the opening in bottom member 2. Cover 3 may here be articulated to the rear wall 4 of bottom member 2 and can be latched by means of latch projections (not shown) in front wall 5. At bottom 6 of bottom member 2, a supply spool 7 is rotatably mounted from which a ribbon, e.g. a single-use carbon ribbon 8 is unwound. A guide 12 guides carbon ribbon 8 past deflection bolts 9, 10, 11 to an exit opening 13 and then, by way of a guide 14 it returns to an entrance opening 15 of cassette 1. Then, carbon ribbon 8 is guided past a deflection bolt 16 to a take-up spool 17 where carbon ribbon 8 is wound up. The core 18 of take-up spool 17 is rotatably mounted on the bearing pin 19 of a holder 20. In order to assure that the sides of take-up spool 17 are always placed in the correct position with respect to bearing pin 19, bearing bore 37 has a blind bore configuration, see FIG. 2. A spring 22 is articulated to holder 20 which is pivotal about a pin 21, the spring taking care that carbon ribbon 8 on take-up spool 17 is always pressed against the sprocket wheel 23 of a supply roller 24 mounted in bottom 6. Thus, rotation of supply roller 24 causes carbon ribbon 8 to be wound securely onto take-up spool 17.

The free end 25 of ribbon 8 on the full supply spool 7 is provided with a fastening means for a guide element serving to thread ribbon 8 around deflection points 9, 10, 11, 12, 14, 16 in cassette 1. This fastening means can be fixed to the core 18 of take-up spool 17 so as to wind up ribbon 8. The fastening means is disposed at the free end 25 of a ribbon piece 49 which encloses the wound ribbon 26 in an overlapping manner. The fastening means may be, for example, an eye 27 into which a guide pin 28 can be inserted. Guide pin 28 may also be fixed to the ribbon piece 49 by means of an adhesive connection. For this purpose, the free end 25 of ribbon piece 49 may have an adhesive surface to which guide pin 28 is fixed. The free end 25 of ribbon piece 49 holds wound ribbon 26 together with a firm loop so that the wound ribbon 26 cannot be unwound. For this purpose, the contacting faces of the loop of ribbon piece 49 may be firmly glued to one another.

Core 18 of take-up spool 17 is provided with a fastening device for fastening it to the free end 25 of ribbon 8 on supply reel 7. The fastening device is, for example, a receiving bore 29 in core 18 of take-up spool 17 into which guide pin 28 can be inserted. Receiving bore 29 is additionally provided with a passage slit 30 leading to a recess 31 which serves as a threading slot and is disposed in the outer circumference of core 18 of take-up spool 17. This enhances very much the fastening of free end 25 to core 18 of take-up spool 17. Guide pin 28 includes, on the one hand, a guide projection 32 which projects over the width of ribbon 8 for guides 33, 34 of bottom 6 in bottom member 2 and, on the other hand, a handle 35 to facilitate threading of ribbon 8. Handle 35 is connected with guide pin 28 by way of a portion of less material 36 which enhances separation of handle 35 after insertion of guide pin 28 into receiving bore 29. Guides 33, 34 are disposed in the region of deflections 9, 10, 11, 14, 16 in bottom member 2 and are provided with mound shaped raised portions.

To facilitate insertion of a full supply spool 7 into cassette 1, spool core 38 of supply spool 7 is provided on its upper side with a projecting handle 39. Spool core 38 of supply reel 7 has a recess 40 on its underside to accommodate handle 39. In this way it is possible to stack a plurality of supply spools 7 on top of one another for secure storage.

For shipping and storage of the ribbon spools, a package 47 as shown in FIG. 3 is provided which is composed of a cup-shaped bottom member 41 and a cover 42 which closes the bottom member. Cover 42 and bottom member 41 each have an opening 43, 44 for the passage of handle 39 which likewise assures that packages 47 stack properly. Package 47 has a block-shaped design. Core 18 of take-up spool 17 is mounted in package 47 in one of the free corners between cupbottom shaped bottom member 41 and the outer turn 45 on supply spool 17. Moreover, guide pin 28 which is connected with the free end 25 of supply spool 7 may be releasably connected, e.g., by means of an adhesive connection, with a wall 46 of bottom member 41.

To always hold the carbon ribbon taut in cassette 1, supply spool 7 is firmly connected with a sprocket disc 48 into whose teeth the blocking tooth 52 of a spring tensioned (53) pivot lever 50 can be engaged. Moreover, deflection bolt 10 is mounted on pivot lever 50. If carbon ribbon 8 is moved as shown in FIG. 1 in the direction of arrow 65, pivot lever 50 pivots clockwise around bearing pin 51 so that blocking tooth 52 goes out of engagement with sprocket disc 48. This releases supply reel 7 for unwinding carbon ribbon 8. When the tension in carbon ribbon 8 decreases, the force of spring 53 causes sprocket tooth 52 to go back into engagement with sprocket disc 48.

Within the scope of the invention, sprocket disc 48 may also be made in one piece with core 38 of supply spool 7. This considerably facilitates installation of supply spool 7 in cassette 1. Moreover, sprocket disc 48 supports the full coil on supply spool 7 in such a manner that the coil cannot bulge out.

To exchange take-up spool 17 and supply spool 7, it is merely necessary to bring holder 20 and the rotatably mounted take-up spool 17 out of engagement with sprocket wheel 23 of supply roller 24. Bringing holder 20 out of engagement with take-up spool 17 can be effected by means of a pivot lever 54 which is pivotally mounted in a recess 55 in side wall 56 of bottom member 2 of cassette 1. With the aid of this pivot lever, holder 20 and take-up reel 17 can be pressed into a latched position so as to decouple sprocket wheel 23 from the outer turn 45 of take-up spool 17. This pivot lever 54 has one arm 57 which is provided with a handle 58 and a second abutment arm 59 provided with an abutment 60 which can be brought into engagement with holder 20. To keep holder 20 in the latched position, abutment arm 59 is provided with a resilient latch 61 which, in the latched position, can be engaged behind a latch edge 62 at spring-tensioned holder 20. After a new take-up spool has been introduced, holder 20 is unlatched again by means of pivot lever 54 in such a manner that sprocket wheel 23 is again brought securely into engagement with the outer turn of take-up spool 17. To hold pivot lever 54 in its out-of-engagement position in recess 55, recess 55 is provided with a notch 63 in which a latch edge 64 of pivot lever 54 can engage.

The ribbon spools 7, 17 according to the invention permit easy exchange, with the no longer required exchangeable parts involving only a small amount of material.

We claim:

1. A ribbon cassette for an office machine, comprising:

a cassette housing removably mountable in the machine, said housing having an entrance opening, an exit opening, an openable cover and elements constituting deflection points;

a supply spool and a take-up spool having a core, said take-up spool being mounted on a pivotable holder arm each of said spools being removably mounted in said cassette housing;

a carbon ribbon initially wound in the form of a coil on said supply spool, said ribbon having a leading end at the outer surface of the coil to be received by said take-up spool core to permit said ribbon to be wound up on said take-up spool while being unwound from said supply spool;

a supply roller having a sprocket wheel;

a spring mechanism operable for pressing said carbon ribbon on said take-up spool against said sprocket wheel so that rotation of said supply roller winds said carbon ribbon onto said take-up spool;

an actuating member disposed in said cassette housing operable for bringing said take-up spool into a latched position so that said supply roller is out of engagement with the carbon ribbon of said take-up spool, said actuating member comprising a pivotally mounted lever having one end bearing against the holder arm and another end forming a handle, actuation of said handle causing said holder arm to pivot said take-up spool away from said sprocket wheel, and said supply spool and said take-up spool can be exchanged by folding open said cover of said cassette housing; and fastening means secured to said leading end of said ribbon for threading said ribbon around said deflection points, said fastening means including a guide pin attached to the leading end of said ribbon and a handle portion separably connected to said guide pin by means of a frangible connection, said handle portion being broken from said pin after threading of said ribbon about said deflection points from the supply spool to the take-up spool;

wherein said core is formed for enabling said fastening means to be fixed thereto to aid winding of said ribbon on said take-up spool.

2. Cassette according to claim 1 wherein said ribbon comprises a ribbon piece extending to said leading end and having an ink-free portion at said leading end, said ribbon piece being at the exterior of the ribbon coil when said ribbon is wound on said supply spool.

3. Cassette according to claim 2 wherein the portion of said ribbon piece at said leading end is constructed to hold said ribbon in a tight coil to prevent said ribbon from being inadvertently unwound.

4. Cassette according to claim 3, wherein said ribbon piece has contact surfaces which are glued together.

5. Cassette according to claim 2, wherein said guide pin is fixed to the ribbon piece by an adhesive connection.

6. Cassette according to claim 2, wherein the ink-free portion of the ribbon piece has an adhesive surface to which said guide pin is fixed.

7. Cassette acording to claim 2, wherein said fastening means has an eye into which said guide pin is inserted.

8. Cassette according to claim 7, wherein the core of said take-up reel comprises a fastening device for fastening the free end of the ribbon to the core.

9. Cassette according to claim 8, wherein said fastening device has a receiving bore for receiving said guide pin.

10. Cassette according to claim 9, wherein said receiving bore has a passage slit and a recess, and wherein said passage slit leads to said recess which serves as a threading slot in the outer circumference of the core of said take-up spool.

11. Cassette according to claim 10, wherein said guide pin has a guide projection which projects across the width of said ribbon.

12. Cassette according to claim 11, wherein said handle comprises a connecting part via which said handle is connected to said guide pin and which constitutes a weakened portion of said handle forming said frangible connection for facilitating removal of said handle after said guide pin is inserted in said receiving bore.

13. Cassette according to claim 12, wherein said housing has a bottom member carrying ribbon guides and carrying said elements constituting deflection points in the form of mound-shaped raised portions.

14. Cassette according to claim 1, wherein said supply spool has a core provided with a projecting handle at the side of said supply spool which will face said cassette housing cover when said supply spool is installed in the cassette.

15. Cassette according to claim 14, wherein said supply spool core is further provided, at the side of said spool which faces away from said projecting handle, with a recess dimensioned to receive said projecting handle of another said supply spool, whereby a plurality of such supply spools may be stacked in a compact manner atop one another.

16. Cassette according to claim 15, in combination with a package for housing said spools and ribbon, said package having a cup-shaped bottom member and a cover for closing said bottom member, said cover having an opening for passage of said projecting handle and said bottom member having an opening aligned with said opening in said cover for passage of the projecting handle of another said supply spool.

17. Cassette according to claim 16, wherein said package has a polygonal form and said take-up spool is stored in a corner of said package adjacent said ribbon.

18. Cassette according to claim 17, wherein said guide pin held by said fastening means is releasably fastened to a side wall of said bottom member.

19. Cassette according to claim 1, wherein said cassette housing has a cup-shaped bottom said bottom having a side wall with a recess therein and said cover has a planar configuration, wherein said supply roller is fixed in the cup-shaped bottom, and wherein said pivotally mounted lever is mounted in said recess of said side wall of said bottom member of said cassette.

20. Cassette according to claim 19, wherein said pivatally mounted lever comprises a first arm and a second arm, said first arm having said handle thereon and said second arm having an abutment which engages with said holder.

21. Cassette according to claim 20, wherein said holder has a latch edge and said second arm has a resilient latch projection which, in the latched position, is latched behind the latch edge of said holder.

* * * * *